United States Patent [19]

Masterson

[11] Patent Number: 4,599,107

[45] Date of Patent: Jul. 8, 1986

[54] METHOD FOR CONTROLLING SECONDARY TOP-BLOWN OXYGEN IN SUBSURFACE PNEUMATIC STEEL REFINING

[75] Inventor: Ian F. Masterson, Danbury, Conn.

[73] Assignee: Union Carbide Corporation, Danbury, Conn.

[21] Appl. No.: 735,741

[22] Filed: May 20, 1985

[51] Int. Cl.[4] ..... C21C 5/32; C21C 5/34

[52] U.S. Cl. ..... 75/59.2

[58] Field of Search ..... 75/59.2

[56] References Cited

U.S. PATENT DOCUMENTS

| | | | |
|---|---|---|---|
| 3,854,932 | 12/1974 | Bishop | 75/60 |
| 3,953,199 | 4/1976 | Michaelis | 75/60 |
| 4,272,287 | 6/1981 | Yajima et al. | 75/60 |
| 4,280,838 | 7/1981 | Murukawa et al. | 75/60 |
| 4,308,057 | 12/1981 | Ono et al. | 75/60 |
| 4,356,035 | 10/1982 | Brotzmann et al. | 75/52 |
| 4,365,992 | 12/1982 | Sieckman | 75/60 |
| 4,369,060 | 1/1983 | Metz et al. | 75/60 |
| 4,402,739 | 9/1983 | Nakanishi | 75/59.2 |
| 4,409,024 | 10/1983 | Kato | 75/59.2 |
| 4,443,252 | 4/1984 | Kreijger et al. | 75/48 |
| 4,462,825 | 7/1984 | Messina | 75/60 |
| 4,488,903 | 12/1984 | Mehlman | 75/52 |

FOREIGN PATENT DOCUMENTS 2082624 3/1982 United Kingdom .

*Primary Examiner*—Peter D. Rosenberg

*Attorney, Agent, or Firm*—Stanley Ktorides

[57] ABSTRACT

A steelmaking method which enables accurate prediction of the split of top-injected oxygen between that which reacts with the bath and that which reacts with carbon monoxide above the bath.

15 Claims, 2 Drawing Figures

METHOD FOR CONTROLLING SECONDARY TOP-BLOWN OXYGEN IN SUBSURFACE PNEUMATIC STEEL REFINING

TECHNICAL FIELD

This invention relates to subsurface pneumatic refining of steel wherein oxygen is additionally injected onto the steel bath from above the bath surface.

BACKGROUND ART

In a subsurface pneumatic steel refining process, oxygen is injected into a steel melt from below the melt surface to decarburize the melt. Subsurface injected oxygen reacts with carbon in the melt to form carbon monoxide which then bubbles up through and out of the melt, thus serving to remove carbon from the melt. The reaction of oxygen and carbon to form carbon monoxide is exothermic and this serves to give added benefit by providing heat to the melt so as to assist in achieving the desired tap temperature of the melt.

Although the reaction of oxygen and carbon to form carbon monoxide is beneficially exothermic, their reaction to form carbon dioxide is considerably more exothermic. For example, the theoretical heat generated by the reaction of one mole of carbon and one-half mole of oxygen gas to form one mole of carbon monoxide is 26.4 kilocalories, while the theoretical heat generated by the reaction of one mole of carbon and one mole of oxygen gas to form one mole of carbon dioxide is 96.05 kilocalories. These facts are well known to those skilled in the art and a number of processes have been advanced to take advantage of these chemical reaction thermodynamics in order to produce greater heat from the decarburization of a steel melt.

One such process involves injecting oxygen onto the bath surface in addition to that injected into the melt from below the melt surface. This top-injected oxygen reacts with carbon monoxide in the head space above the bath surface. This carbon monoxide, which has bubbled up through and out of the melt, then forms carbon dioxide thus generating the additional heat alluded to above in discussing the difference between the reaction of carbon and oxygen to form carbon dioxide as opposed to carbon monoxide. Also, it has been demonstrated that the combustion of carbon monoxide above the surface of a chromium containing steel melt that is decarburized by the injection of oxygen beneath the surface of the bath, supresses the the oxidation of chromium and in effect increases the rate of carbon removal without increasing the rate at which oxygen is injected into the molten bath.

Not all of the top-injected oxygen reacts with carbon monoxide in the headspace to form carbon dioxide. Some of this top-injected oxygen impacts the bath and reacts with bath constituents. Some of these bath constituents may be silicon or aluminum which may have been added to the melt to provide heat to the melt. Other bath constituents with which top-injected oxygen may react include chromium, manganese and iron. The reaction of top-injected oxygen with carbon has the beneficial aspect of assisting in the decarburization of the steel melt, thus reducing the time and hence the cost of refining any given steel melt to any given desired final carbon content.

However, this process has heretofore had the major disadvantage of introducing an uncertainty into the decarburization process. This is because the percentage of oxygen which reacts with carbon monoxide in the headspace and the percentage of oxygen which reacts with bath constituents could not be accurately predicted and controlled. When refining plain carbon steels containing less than two percent total alloying elements such as manganese and chromium, carbon is the main bath constituent that is oxidized during decarburization. Thus when refining plain carbon steels the amount of carbon removed from the steel melt could not be precisely controlled because of the uncertainty of exactly how much carbon is oxidized by the top-injected oxygen. This is not a major problem when the steel being made has a wide carbon specification. However, this process for increasing the heat generated by decarburization has severe limitations if one desires a steel with a precisely defined carbon content.

In the production of high quality low alloy or stainless steels containing greater than two percent alloying elements such as manganese and chromium, these elements are oxidized along with carbon during decarburization. Thus it is necessary to add a deoxidant to the molten bath after the desired carbon level has been obtained, in order to recover valuable metallics, such as chromium and manganese present in the slag as oxides. The deoxidant, which generally is silicon or aluminum, will combine with the metallic oxides to form aluminum oxide or silicon dioxide, leaving the valuable metallics in their elemental form such as chromium and manganese. The valuable metallics will remain in the melt while the aluminum oxide and silicon dioxide will remain in the slag. In order to effectively recover the oxidized metallics while obtaining specification silicon and/or aluminum content of the steel, it is necessary to know the quantity of top-injected oxygen that reacts with bath components.

It is therefore an object of this invention to provide an improved method of refining a steel melt by subsurface oxygen injection with secondary top-blown oxygen.

It is another object of this invention to provide an improved method of refining a steel melt by subsurface oxygen injection with secondary top-blown oxygen wherein the percentage of top-blown oxygen which reacts with bath constituents in accurately predicted and controlled.

SUMMARY OF THE INVENTION

The above and other objects which will become apparent to those skilled in the art upon a reading of this disclosure are attained by the present invention which is:

A method for refining a carbon-containing steel melt in a refining vessel, comprising:

(a) injecting oxygen into the steel melt from below the bath surface;

(b) reacting at least some of the subsurface injected oxygen with carbon in the melt to produce carbon monoxide which rises up through and out of the bath;

(c) injecting oxygen through a lance into the headspace above the bath surface (d) reacting a first portion of the top-injected oxygen with components in the bath and a second portion of the top-injected oxygen with the rising carbon monoxide in the headspace above the bath surface; and (e) attaining a desired proportion of top-injecting oxygen which reacts with bath components by substantially satisfying the relationship $$P=K-(1629/\text{sec})\ (L/V)$$

where P is the desired percent of top-injected oxygen which reacts with bath components, L is the height of the lance opening above the bath surface in feet, V is the velocity of the oxygen injected from the lance in feet per second, and K is a constant having a value of from 56 to 72.

As used herein the term "bath" means the contents inside a steelmaking vessel during refining, and comprising a melt, which comprises molten steel and material dissolved in the molten steel, and a slag, which comprises material not dissolved in the molten steel.

As used herein, the terms "top-injected" and "top-blown" mean injected into the headspace above the bath surface.

As used herein, the term "subsurface injected" means injected into a melt from below the bath surface.

As used herein, the term "lance" means a tubular device for carrying oxygen having an opening, of constant cross-sectional area, through which oxygen is injected into the headspace.

As used herein, the term "lance height" means the vertical distance from the calculated quiescent bath surface to the lance opening.

As used herein, the term "headspace" means the space in a steelmaking vessel above the bath surface.

As used herein, the terms "argon oxygen decarburization process" or "AOD process" means a process for refining molten metals and alloys containing in a refining vessel provided with at least one submerged tuyere comprising:

(a) injecting into the melt through said tuyere(s) an oxygen-containing gas containing up to 90 percent of a dilution gas, wherein said dilution gas may function to reduce the partial pressure of the carbon monoxide in the gas bubbles formed during decarburization of the melt, alter the feed rate of oxygen to the melt without substantially altering the total injected gas flow rate, and/or serve as a protective fluid, and thereafter (b) injecting a sparging gas into the melt through said tuyere(s) said sparging gas functioning to remove impurities from the melt by degassing, deoxidation, volatilization or by floatation of said impurities with subsequent entrapment or reaction with the slag. Useful dilution gases include argon, helium, hydrogen, nitrogen, steam or a hydrocarbon. Useful sparging gases include argon, helium, hydrogen, nitrogen, carbon monoxide, carbon dioxide, steam and hydrocarbons. Liquid hydrocarbons may also be employed as protective fluids. Argon and nitrogen are the preferred dilution and sparging gas. Argon, nitrogen and carbon dioxide are the preferred protective fluids.

DETAILED DESCRIPTION

Figure 1:
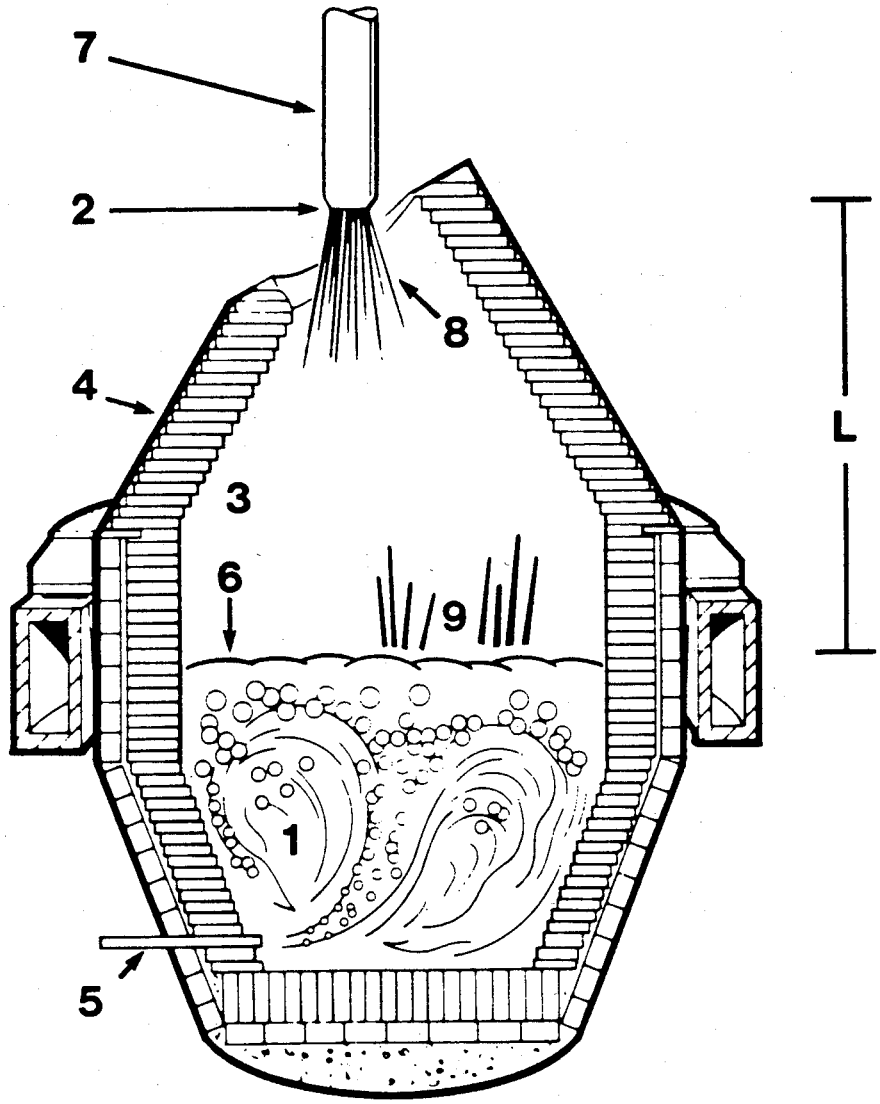
FIG. 1 is a simplified representation of a steelmaking vessel similar to those employed in carrying out Examples 1 and 2 and in carrying out the steelmaking heats which served to generate the data represented in FIG. 2.

The present invention is a method which enables one to generate large quantities of heat during steel refining by the complete combustion of carbon to carbon dioxide while retaining excellent carbon end point accuracy and the effective recovery of valuable alloy constituents while attaining accurate specification silicon and/or aluminum contents. The method combines an efficient high quality bottom blowing procedure, such as the AOD process, with a defined top blowing procedure so as to enable injection of oxygen into the headspace above the melt to complete the carbon combustion reaction while still retaining excellent control over the decarburization so as to ensure carbon end point accuracy.

The method of this invention may be effectively employed with any subsurface pneumatic steel refining process. By subsurface pneumatic steel refining it is meant a process wherein decarburization of the melt is achieved by the subsurface injection of oxygen gas alone or in combination with one or more fluids selected from the group of argon, nitrogen, ammonia, steam, carbon monoxide, carbon dioxide, hydrogen, methane or higher hydrocarbon gases and liquids. The fluids may be injected into the melt by following one or more blowing programs depending on the grade of steel being made and on the specific fluids used in combination with oxygen. The refining period frequently ends with certain finishing steps such as lime and/or alloy additions to reduce the oxidized alloying elements to adjust the melt composition to meet melt specifications. Among such subsurface pneumatic steel refining processes one can name the AOD, CLU, OBM, Q-BOP and LWS processes. The preferred subsurface pneumatic steel refining process in the AOD process. When the AOD process is employed, the ratio of oxygen to inert gas injected by subsurface injection into the melt may be constant, or it may vary, and generally is within the range of from 5:1 to 1:9.

In the process of this invention oxygen is injected into a steel melt from below the bath surface. The subsurface injected oxygen is injected into the melt at a rate in the range of from 500 to 6000, preferably from 750 to 3000 cubic feet of oxygen per ton of melt per hour. The steel melt contains carbon and typically the carbon content of the steel melt is in the range of from about 5 to 0.2 percent. Some of the subsurface injected oxygen, and preferably the major part, reacts with carbon in the melt to form carbon monoxide which forms bubbles which rise up and through and out of the melt. This reaction is exothermic and serves to provide heat to the melt as well as to remove carbon from the melt.

Oxygen is injected through a lance into the headspace above the bath surface so that it impacts the surface of the slag layer above the melt surface. A first portion of the oxygen penetrates the slag layer and reacts with constituents in the melt and/or the slag while a second portion of the top-injected oxygen remains in the headspace and reacts with carbon monoxide which has risen up through and out of the melt. The top injected oxygen is injected at a rate in the range of from 25 to 150 percent, preferably from 30 to 90 percent of the rate of which the subsurface injected oxygen is injected into the melt.

The top injected oxygen is injected into the headspace through a lance having an opening whose width may be in the range of from 0.5 to 2 inches. The lance opening may be within the headspace or may be a short distance above the headspace. The lance is generally oriented perpendicular to the bath surface so that the top-injected oxygen impacts the slag at a right angle, however, if desired, the lance may be at a small angle from perpendicular to the melt. The oxygen is injected from the lance opening at a velocity V which generally may be in the range of from 150 feet per second to sonic velocity. Preferably the velocity V is at least 150 feet per second in order to reduce the wear rate of the oxygen lance. The lance opening is at a vertical distance L above the bath surface which is in the range of from 22 to 150 inches (1.83 to 12.5 feet), preferably from 36 to 120 inches (3 to 10 feet). The lance height can be chosen once the size of the lance and the oxygen flowrate is set so as to yield the desired percentage of top-injected oxygen reacting with bath components.

The invention comprises the discovery that the amount of top-injected oxygen which reacts with bath components can be predicted and thus controlled. That is, the split between the top-injected oxygen which reacts with bath components and that which reacts above the bath surface can now be accurately predicted. This, in turn, enables the attainment of excellent carbon end point accuracy since the amount of carbon removed by the top-injected oxygen, in addition to that removed by the subsurface injected oxygen can be controlled.

This advantageous result is achieved by satisfying the relationship $$P=K-(1629/\text{sec})\ (L/V)$$

where P is the percentage of the top injected oxygen which one desires to react with the melt. Thus by altering the lance height L and/or the oxygen velocity V, one can, in accord with the formula, attain a desired percentage P of the oxygen reacting with the melt. By means of the present invention one can now predict how much top-injected oxygen will react with the bath components and thus accurately control the amount of carbon oxidized by the top-injection of oxygen. Now by the use of this invention one can use the advantageous added heat generated by the combustion of carbon monoxide to carbon dioxide in the headspace above a steel bath while avoiding the heretofore experienced uncertainty in the carbon end point cause by the variation in the split between top-injected oxygen which reacts respectively with the bath and above the bath.

The following examples serve to further illustrate the invention. They are presented for illustrative purposes and are not intended to be limiting.

EXAMPLE I

A five ton low alloy steel melt having an initial carbon content of 0.39 percent was refined in an AOD vessel 4 of a design similar to that of FIG. 1. The numerals herein refer to those of FIG. 1. Oxygen at a rate of 1600 cubic feet per ton per hour was injected through tuyere 5 into steel melt 1 from below the bath surface along with carbon dioxide as inert gas at a rate of 400 cubic feet per ton per hour. Oxygen reacted with carbon in the melt to form carbon monoxide which bubbled up through and out of the bath. This carbon monoxide is shown as arrows 9 in FIG. 1 The lance opening 2 was 46 inches from the bath surface 6 and oxygen 8 was injected through the lance 7 into the headspace 3 at a velocity of 485 feet per second. Thus the L/V ratio was 0.008. The relationship of the invention predicted that 51±8 percent of the top-injected oxygen would react with bath components. After the steel was refined, the average percentage of top-injected oxygen, which reacted with the bath was calculated to be 55 percent.

EXAMPLE 2

A fifty ton stainless steel melt having an initial carbon content of 1.46 percent was refined in an AOD vessel 4 of a design similar to that of FIG. 1. As in Example 1, the numerals herein correspond to those of FIG. 1. Oxygen at a rate of 1000 cubic feet per hour per ton was injected through tuyere 5 into steel melt 1 from below the bath surface along with nitrogen as inert gas at a rate of 250 cubic feet per hour per ton for one time step, and at a rate of 333 cubic feet per hour per ton for another time step. Oxygen reacted with carbon in the melt to form carbon monoxide which bubbled up through and out of the bath. This carbon monoxide is shown as arrows 9 in FIG. 1. The lance opening 2 was 9.5 feet from the bath surface 6 and oxygen 8 was injected through the lance 7 into the headspace 3 at sonic velocity. Thus the L/V ratio was 0.009. The relationship of the invention predicted that 49±8 percent of the top-injected oxygen would react with bath components. After the steel was refined, the percentage of top-injected oxygen which reacted with the bath was calculated to be 50 percent.

Figure 2:
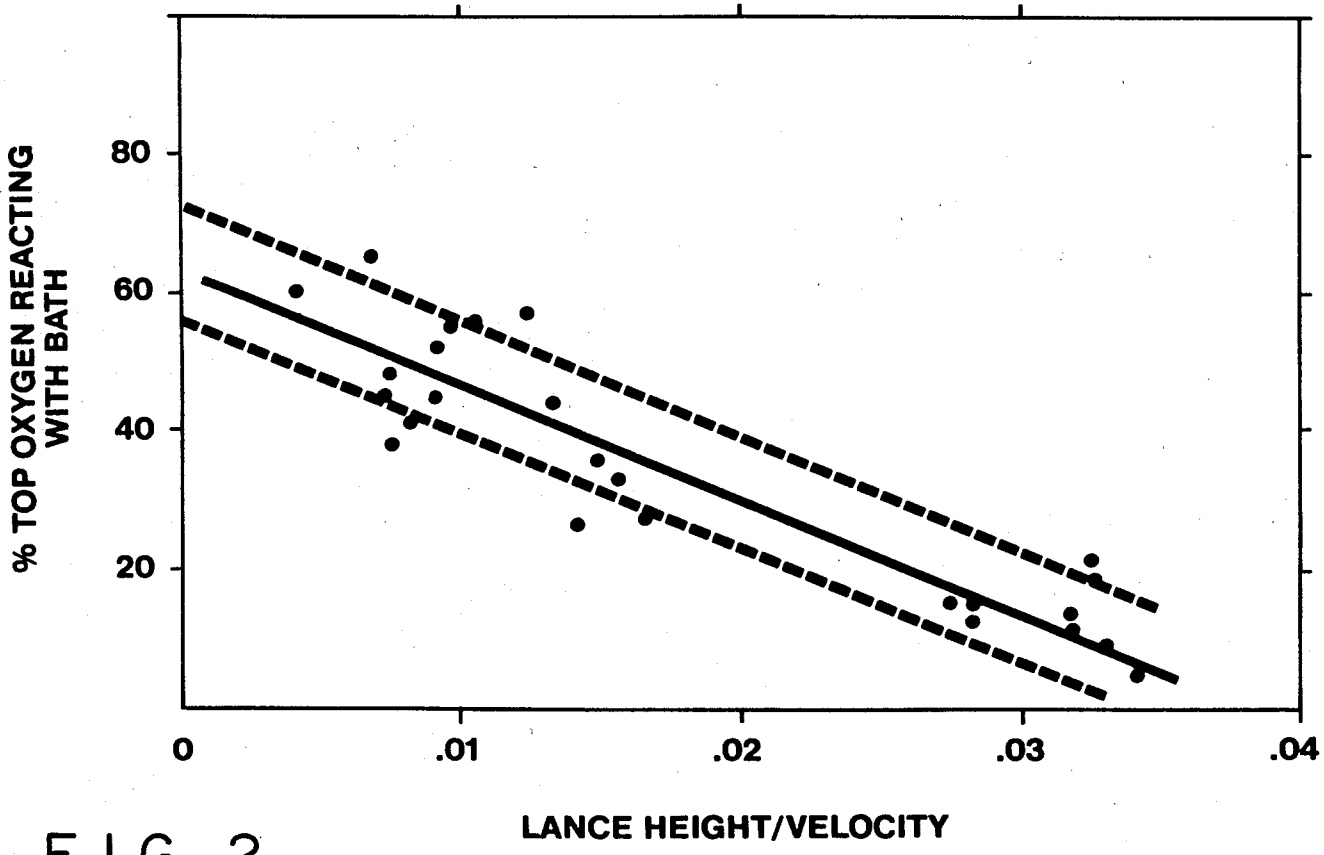
FIG. 2 is a graphical representation of the percentage of top-injected oxygen which reacts with bath components as a function of the ratio of lance height to top-injected oxygen velocity for a number of steelmaking heats.

The method of this invention may effectively be employed to refine all steels such as stainless steels, low alloy steels, carbon steels and tool steels. Referring now to FIG. 2, there is shown a graphical representation of data showing the relationship of the percentage of top injected oxygen reacting with the bath as a function of the ratio of lance height to top-injected oxygen velocity. The dark dots represent individual data points. The data points shown in FIG. 2 were collected from operating AOD vessels having nominal capacities in the range of from 60 to 3 tons using top-injected oxygen during decarburization when refining carbon steels, low alloy steels, or stainless steels. The dark solid line through the center of the data points represents the midpoint of the value of K in the relationship of this invention. The lighter dotted lines which parallel the midpoint line above and below the dark solid line represent the end points, i.e., 56 and 72, of the value of K in the relationship of this invention. The average value of K is about 64.

I claim:

1. A method for refining a carbon-containing steel melt in a refining vessel, comprising:

(a) injecting oxygen into the steel melt from below the bath surface:

(d) reacting at least some of the subsurface injected oxygen with carbon in the melt to produce carbon monoxide which rises up through and out of the bath;

(c) injecting oxygen through a lance into the headspace above the bath surface;

(d) reacting a first portion P of the top-injected oxygen with components in the bath wherein $$P=K-(1629/\text{sec})\ (L/V)$$

where P is the percent of top-injected oxygen which reacts with bath components, L is the height of the lance opening above the bath surface in feet, V is the velocity of the oxygen injected from the lance in feet per second, and K is a constant having a value of from 56 to 72; and (e) reacting remaining top-injected oxygen with said rising carbon monoxide in the headspace above the bath surface to exothermically produce carbon dioxide.

2. The method of claim 1 wherein the melt has an initial carbon content in the range of from 5 to 0.2 percent.

3. The method of claim 1 wherein the subsurface injected oxygen is injected into the melt at a rate in the range of from 500 to 6000 cubic feet per ton of steel melt per hour.

4. The method of claim 1 wherein the subsurface injected oxygen is injected into the steel melt along with an inert gas.

5. The method of claim 1 wherein the top-injected oxygen is injected into the headspace at a rate in the range of from 25 to 150 percent of the subsurface injected oxygen injection rate.

6. The method of claim 1 wherein the top-injected oxygen is injected from the lance at a rate in the range of from 150 feet per second to sonic velocity.

7. The method of claim 1 wherein the lance opening is at a vertical distance from the bath surface in the range of from 22 to 150 inches.

8. The method of claim 1 wherein the lance opening is within the headspace above the bath surface.

9. The method of claim 1 wherein the lance opening is above the headspace above the bath surface.

10. The method of claim 1 wherein the lance is oriented perpendicular to the bath surface.

11. The method of claim 1 wherein the lance is oriented at a non-perpendicular angle to the bath surface.

12. The method of claim 1 employing the AOD process, wherein subsurface injected oxygen is injected into the melt, having an initial carbon content of from 0.02 to 3 percent, at a rate in the range of from 500 to 3000 cubic feet per ton of steep per hour.

13. The method of claim 1 wherein the steel being refined is plain carbon steel.

14. The method of claim 1 wherein the steel being refined is low alloy steel.

15. The method of claim 1 wherein the steel being refined is stainless steel.

* * * * *

UNITED STATES PATENT AND TRADEMARK OFFICE

CERTIFICATE OF CORRECTION

PATENT NO. : 4,599,107

DATED : July 8, 1986

INVENTOR(S) : I.F. Masterson

It is certified that error appears in the above-identified patent and that said Letters Patent is hereby corrected as shown below:

In column 3, line 33 delete "containing" and insert therefor --contained--.

In claim 12, line 5 delete "steep" and insert therefor --steel--.

Signed and Sealed this

*Thirtieth* Day of *September 1986*

[SEAL]

*Attest:*

DONALD J. QUIGG

*Attesting Officer*

*Commissioner of Patents and Trademarks*